US006624598B2

(12) United States Patent
Buij et al.

(10) Patent No.: US 6,624,598 B2
(45) Date of Patent: Sep. 23, 2003

(54) BALLAST AND METHOD OF FEEDING A FLUORESCENT LAMP

(75) Inventors: Arnold Willem Buij, Eindhoven (NL); Marcel Beij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/050,250

(22) Filed: Jan. 16, 2002

(65) Prior Publication Data

US 2002/0097009 A1 Jul. 25, 2002

(30) Foreign Application Priority Data

Jan. 22, 2001 (EP) ..... 01200217

(51) Int. Cl.[7] ..... H05B 41/00

(52) U.S. Cl. ..... 315/291; 315/209 R; 315/307; 315/DIG. 4

(58) Field of Search ..... 315/291, 307, 315/308, 209 R, DIG. 4, 219

(56) References Cited

U.S. PATENT DOCUMENTS 4,958,108 A * 9/1990 Jorgensen ..... 315/307
5,528,111 A * 6/1996 Konopka et al. ..... 315/291
5,612,595 A * 3/1997 Maheshwari ..... 315/291
5,680,017 A * 10/1997 Veldman et al. ..... 315/308
5,910,713 A 6/1999 Nishi et al. ..... 315/308
5,952,793 A 9/1999 Nishi et al. ..... 315/307
6,150,772 A * 11/2000 Crane ..... 315/291
6,291,946 B1 9/2001 Hinman ..... 315/307
6,307,765 B1 * 10/2001 Choi ..... 315/DIG. 4
6,316,886 B1 11/2001 Luger et al. ..... 315/307

FOREIGN PATENT DOCUMENTS

WO WO 00/24232 4/2000

* cited by examiner

*Primary Examiner*—Don Wong
*Assistant Examiner*—Ephrem Alemu

(57) ABSTRACT

A ballast for feeding a fluorescent lamp, comprising a power supply unit controlled by an input variable, dimming means for adjusting the desired power through the lamp, and a control circuit for adapting the input variable from a starting value to a final value, the actual value through the lamp being at least substantially equal to the adjusted power value, said control circuit additionally comprising processor means capable of determining the starting value in dependence upon the adjusted power value.

8 Claims, 1 Drawing Sheet

BALLAST AND METHOD OF FEEDING A FLUORESCENT LAMP

BACKGROUND OF THE INVENTION

The invention relates to a ballast for feeding a fluorescent lamp, comprising a power supply unit controlled by an input variable, for example a pulse duration-modulated power supply unit, dim means for setting the desired power through the lamp, and a control circuit for adapting the input variable, for example the pulse duration, from a starting value to a final value, the actual power through the lamp being at least substantially equal to the power setting.

Such a ballast is disclosed in international patent application WO 00/24232. The most important function of a ballast is to stabilize the power in a fluorescent lamp. To achieve this, use is made of a control circuit which controls the power supply unit in such a manner that the power supply unit sends the correct power, as set by the dim means, through the lamp. In the case of a pulse duration-modulated power supply unit, this is achieved by adapting the pulse duration from a fixed starting value to a final value at which the desired power is obtained. To achieve this, the control circuit is necessary because the actual power sent through the lamp does not only depend on the pulse duration but also on other factors, such as the temperature of the lamp, the degree of wear of the lamp, variations in supply voltage, variations in the value of power-determining components, such as the coil and the capacitor of the resonant circuit etc. Consequently, there is no proportional relationship between the pulse duration and the power. In ballasts provided with dim means, generally a control circuit in accordance with the integral control principle, also referred to as integrator, is applied. Such a control circuit is characterized by a stabilizing, yet comparatively slow operation. A customary characteristic of such control circuits is that they are capable of, for example, adapting the pulse duration by only 30% per second.

A problem associated with such a ballast is that undesirable light effects may occur. If the starting value of the pulse duration is set to, for example, maximum power, which level is customarily attained at a pulse duration of approximately 45%, and the dim means are set to a low power, for example 10%, then, upon ignition of the lamp, said lamp will initially burn at full power, after which the control circuit will regulate the pulse duration so as to be reduced to approximately 15%. As this requires some time, even if it is only a fraction of a second, the user will first see a flash of light. When the power is being readjusted by means of the dim means, the user will also notice that the reaction of the lamp is slightly delayed if the control circuit must shunt a large difference in power. For example, if the power is increased from 10% to 100%, whereby the pulse duration is increased from approximately 15% to approximately 45%, it may take a full second to complete this process, if the control circuit allows a maximum adaptation of 30% per second.

SUMMARY OF THE INVENTION

It is an object of the invention to provide an inexpensive, effective ballast provided with dim means, which has a shorter response time, and in which said flash effect is less noticeable or completely absent.

To achieve this, the control circuit additionally comprises processor means capable of determining the starting value in dependence on the power setting. Thus, instead of a fixed starting value, for example a pulse duration of 45%, a variable starting value is applied which depends upon the power setting. By choosing the starting value of, for example, the pulse duration to be such that, under average conditions, the desired power is achieved before the control circuit starts functioning (the so-called first guess method), the control circuit only has to carry out the "fine adjustment" to shunt the effects of, for example, temperature and wear. In this manner, a rapid response time is obtained and the flash effect is precluded. The starting value can be determined after ignition of the lamp and also after a change of the desired power setting by the dim means.

Preferably, the control circuit is a digital control circuit, which comprises a digital-to-analog converter that is capable of converting a measured analog power value to a digital power value. In such a digital system, the processor means can readily be used to determine the starting value by means of a mathematical function, or the ballast can additionally be readily provided with memory means, so that the processor means can determine the starting value by means of pairs of power values and starting values stored in the memory means in the form of, for example, a table.

The invention also relates to a method of feeding a fluorescent lamp, wherein dim means are used to set the desired power through the lamp, and wherein a control circuit sets the power supplied to the lamp by an input variable-controlled power supply unit by adapting the input variable from a starting value to a final value, so that the actual power through the lamp is at least substantially equal to the power setting, and wherein the starting value is determined in dependence upon said power setting.

These and other aspects of the invention will be apparent from and elucidated with reference to an exemplary embodiment described hereinafter.

DETAILED DESCRIPTION OF THE INVENTION

Figure 1:
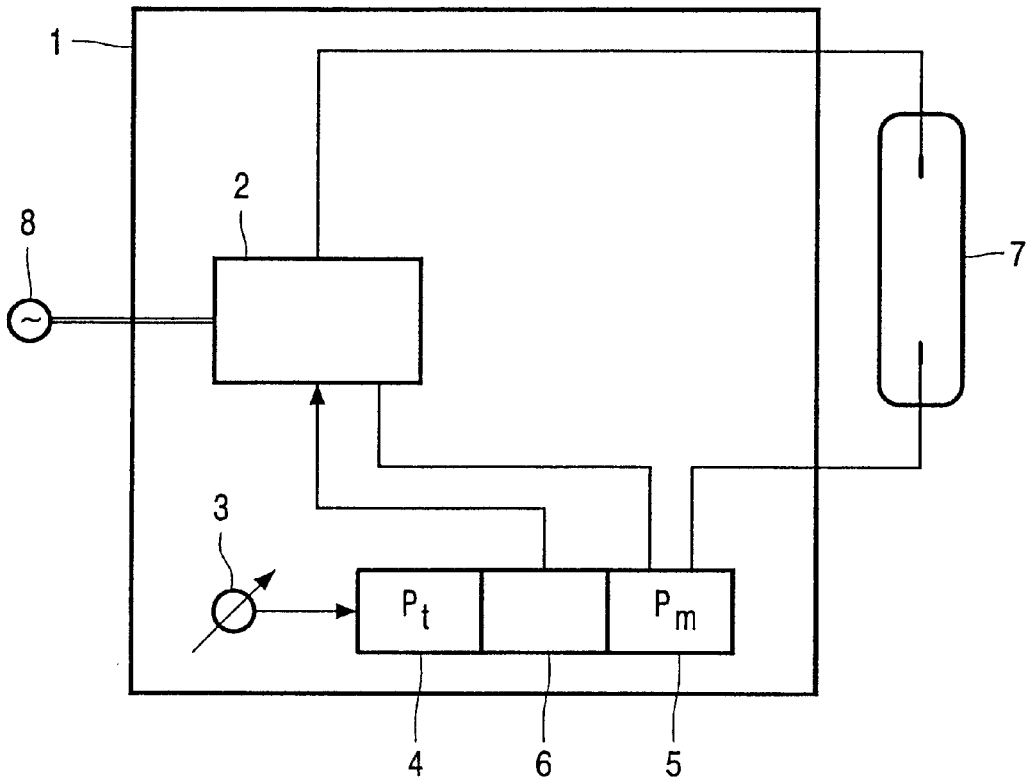
FIG. 1 diagrammatically shows a ballast in accordance with the invention.

In accordance with FIG. 1, a ballast 1 comprises a pulse duration-modulated power supply unit 2 and a dimmer 3 that sets a target power value Pt in memory means 4. In the case of a pulse duration-modulated power supply unit, which is assumed to be known from the prior art, the power supply can be controlled by varying the pulse duration. However, apart from pulse duration-modulated power supply units, other types of power supply units exist wherein the power is controlled by varying an input variable, such as the operating (switching) frequency or the DC supply voltage of the converter, to which the principle of the current invention also applies. In addition, the ballast 1 comprises a control circuit including an analog-to-digital (A/D) sampling device 5 that measures the power Pm through the fluorescent lamp 7 and converts this analog signal by means of an A/D converter to a series of digital values, a processor 6 that compares the measured value Pm with the target value Pt. If the measured power value Pm differs from the target power Pt set by the dimmer 3, then the processor 3 orders the power supply unit 2 to adapt the power sent through the lamp 7 by gradually changing the pulse duration until said target power Pt is achieved. It has hitherto been common practice to take a fixed starting value for the pulse duration after ignition of the lamp 7, at which fixed starting value, for example, the maximum power is supplied, after which said power is adapted by the control circuit until the target value has been attained. As a result, if the dimmer 3 is set to a low power, a short flash of light occurs upon ignition of the lamp because the lamp 7 bums at full power before the power is reduced to the dimmed power.

If the desired power is changed during operation of the lamp by setting the dimmer 3 to a different value, the control circuit will gradually adapt the power until the new, desired power is attained. As, customarily, an integrator control circuit is used which, on the one hand, has a stabilizing effect yet, on the other hand, is comparatively slow, this adaptation will be carried out rather slowly, so that it may be visible and annoying to the user, and hence fails to meet the DALI standard that is well-known in the industry and that prescribes a maximum adaptation time.

For this reason, no fixed starting value for the pulse duration is applied in the ballast in accordance with the invention; instead the starting value is determined instead by the processor means 6 in dependence upon the desired power set by the dimmer 3. If the dimmer 3 is set to a low power, the pulse duration will be directly set to a low value by the processor 6. In this manner, said flash of light is precluded. If another power value is set by the dimmer 3, the processor will also choose a new starting value for the pulse duration, leading to a power which, under normal conditions, will be close to the desired final value. As described hereinabove, the power through the lamp does not only depend on the pulse duration setting of the power supply unit but also on external factors, such as temperature and wear of the lamp 7 as well as other factors as mentioned in the opening paragraph.

Figure 2:
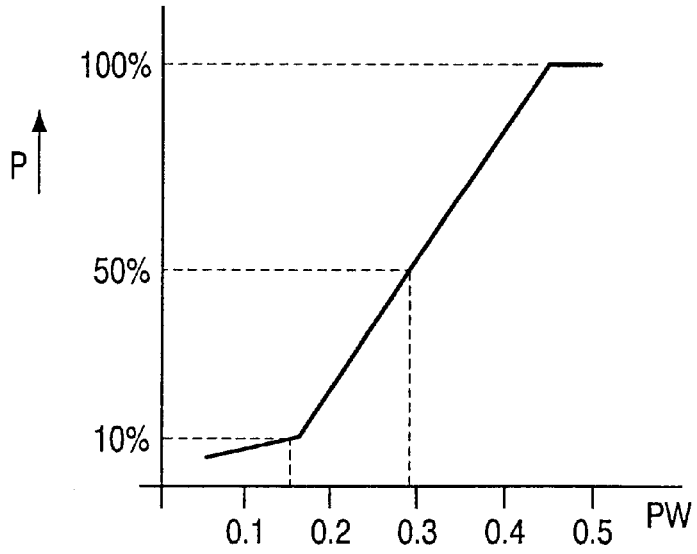
FIG. 2 graphically shows the general connection between the pulse duration of the power supply unit in a ballast and the power flowing through the lamp.

FIG. 2 shows a general connection between the pulse duration and the power through the lamp, as could be the case for a certain lamp under average conditions. This graphically shown connection is used by the processor 6 to determine a starting value for the pulse duration PW by means of the power P set by the dimmer 3. If the desired power P is, for example, 50% of the maximum power, then the graph shows that the starting value for the pulse duration PW should be set to 0.29. This method is referred to as "first guess method" because the starting value thus obtained will generally not directly lead to the desired power but to a value close to said desired power. The control circuit subsequently provides the exact setting.

The connection shown may be included in a table with associated values for the power P and the pulse duration PW. This table will be stored in a memory that can be consulted by the processor 6. The connection can alternatively be represented by a mathematical function that is used by the processor 6 to determine, by means of a power P, the associated pulse duration PW.

What is claimed is:

1. A ballast for feeding power to a fluorescent lamp, said ballast having a power supply unit controlled by an input variable, dim means for setting the desired power through the lamp, and a control circuit for adjusting the input variable from a starting value to a final value, the actual power through the lamp being at least substantially equal to the desired power, wherein the control circuit comprises processor means that sets the starting value in dependence on the desired power.

2. A ballast as claimed in claim 1, characterized in that the power supply unit comprises a pulse duration-modulated power supply unit, and the input variable comprises the pulse duration.

3. A ballast as claimed in claim 1, wherein the control circuit comprises a digital-to-analog converter capable of converting a measured analog power value to a digital power value.

4. A ballast as claimed in claim 1, wherein the processor means determines the starting value by means of a mathematical function.

5. A ballast as claimed in claim 1, wherein the ballast comprises memory means, and the processor means determines the starting value by means of pairs of power values and starting values stored in said memory means.

6. A method of feeding power to a fluorescent lamp, comprising: setting a dim means to a desired power through the lamp, setting the power supplied to the lamp by an input variable-controlled power supply unit by adjusting the input variable from a starting value to a final value, so that the actual power through the lamp is at least substantially equal to the desired power, said starting value being determined in dependence upon said desired power.

7. A method as claimed in claim 6, wherein the starting value is determined after the lamp has been ignited.

8. A method as claimed in claim 6, wherein the starting value is determined when the desired power setting has been changed.

* * * * *